US012808362B2

(12) United States Patent
Chi et al.

(10) Patent No.: US 12,808,362 B2
(45) Date of Patent: Nov. 24, 2026

(54) CRYOGENIC PUMP FOR SEMICONDUCTOR PROCESSING

(71) Applicant: TAIWAN SEMICONDUCTOR MANUFACTURING COMPANY, LTD., Hsinchu (TW)

(72) Inventors: Yu Min Chi, Hsinchu (TW); Yi-Chieh Lo, Taichung (TW); Kuo-Lung Hou, Taichung (TW); Wei-Jen Chen, Hsinchu (TW); Su-Yu Yeh, Hsinchu (TW)

(73) Assignee: TAIWAN SEMICONDUCTOR MANUFACTURING COMPANY, LTD., Hsinchu (TW)

( * ) Notice: Subject to any disclaimer, the term of this patent is extended or adjusted under 35 U.S.C. 154(b) by 0 days.

(21) Appl. No.: 19/287,772

(22) Filed: Jul. 31, 2025

(65) Prior Publication Data

US 2025/0354543 A1 Nov. 20, 2025

Related U.S. Application Data

(62) Division of application No. 18/131,562, filed on Apr. 6, 2023.

(51) Int. Cl.
*F04B 37/08* (2006.01)
*F04D 19/04* (2006.01)

(52) U.S. Cl.
CPC ..... *F04B 37/08* (2013.01); *F04D 19/042* (2013.01)

(58) Field of Classification Search
CPC ..... F04B 37/07; F04B 37/08–085; H01L 21/67017–67086; F04D 19/042
See application file for complete search history.

(56) References Cited

U.S. PATENT DOCUMENTS 3,364,654 A * 1/1968 Westbrock ..... H01J 9/38 96/139
3,668,881 A * 6/1972 Thibault ..... H01J 9/38 95/114
4,072,025 A * 2/1978 Thibault ..... F04B 37/08 55/DIG. 15

(Continued)

FOREIGN PATENT DOCUMENTS

CH 652804 11/1985
CH 652804 A5 * 11/1985 ..... F04B 37/085

(Continued)

*Primary Examiner* — Alexander B Comley
(74) *Attorney, Agent, or Firm* — NZ Carr Law Office

(57) ABSTRACT

Embodiments of the present disclosure provide a method for semiconductor processing, including: loading, into a process chamber, a semiconductor substrate; operating a cryogenic pump coupled to the process chamber to cause a pressure in the process chamber to satisfy a first threshold pressure, the cryogenic pump including: a body having a flange, coupled to the process chamber, and an opening defined at a first end of the body, wherein a longitudinal axis of the body is defined from the first end of the body to a second end of the body, and wherein the body has a non-cylindrical shape with sides sloping radially outward, in relation to the longitudinal axis, in a direction away from the first end and towards the second end; and processing the semiconductor substrate enclosed in the process chamber.

20 Claims, 10 Drawing Sheets

(56) References Cited

U.S. PATENT DOCUMENTS 4,285,710 A * 8/1981 Welch ..... F04B 37/08 62/55.5
4,295,338 A * 10/1981 Welch ..... F04B 37/08 62/55.5
4,311,018 A * 1/1982 Welch ..... F04B 37/08 62/55.5
4,336,690 A * 6/1982 Welch ..... F04B 37/08 62/55.5
4,356,701 A * 11/1982 Bartlett ..... F04B 37/08 165/104.21
4,438,632 A * 3/1984 Lessard ..... F04B 37/02 165/275
4,479,360 A * 10/1984 Bachler ..... F04B 37/08 62/55.5
4,494,381 A * 1/1985 Lessard ..... F04B 37/08 428/116
4,530,213 A * 7/1985 Kadi ..... F04B 37/08 62/55.5
4,546,613 A * 10/1985 Eacobacci ..... F04B 37/08 62/100
4,555,907 A * 12/1985 Bartlett ..... F04B 37/08 62/55.5
4,691,534 A * 9/1987 Lombardini ..... F04B 37/08 96/121
4,718,241 A * 1/1988 Lessard ..... F04B 37/08 62/55.5
4,791,791 A * 12/1988 Flegal ..... F04B 37/08 62/55.5
4,803,845 A * 2/1989 Strasser ..... F04B 37/08 137/601.01
4,862,697 A * 9/1989 Tugal ..... F04B 37/08 62/55.5
4,873,833 A * 10/1989 Pfeiffer ..... B01D 8/00 62/55.5
4,958,499 A * 9/1990 Haefner ..... F04B 37/08 62/55.5
5,000,007 A * 3/1991 Haefner ..... F04B 37/08 62/55.5
5,001,903 A * 3/1991 Lessard ..... F04B 37/08 96/112
5,211,022 A * 5/1993 Bartlett ..... F04B 37/08 62/55.5
5,343,709 A * 9/1994 Kohler ..... F04B 37/08 62/55.5
5,345,787 A * 9/1994 Piltingsrud ..... F04B 37/08 62/55.5
5,386,708 A * 2/1995 Kishorenath ..... F04B 37/08 62/55.5
5,450,729 A * 9/1995 Hilton ..... F04B 37/08 502/527.23
5,513,499 A * 5/1996 deRijke ..... F04B 37/085 62/55.5
5,520,002 A * 5/1996 Ishikawa ..... H01J 37/18 62/55.5
5,582,017 A * 12/1996 Noji ..... F04B 49/065 62/55.5
6,092,373 A * 7/2000 Mundinger ..... F04B 37/085 62/55.5
6,122,920 A * 9/2000 Hill ..... F04B 37/04 62/51.1
6,122,921 A * 9/2000 Brezoczky ..... F04B 37/085 62/55.5
6,155,059 A * 12/2000 Matte ..... F04B 37/08 62/55.5
7,313,922 B2 * 1/2008 Bartlett ..... F04B 37/02 62/55.5
8,366,423 B2 * 2/2013 Baltussen ..... B82Y 10/00 417/423.4
9,666,404 B2 * 5/2017 Frosien ..... H01J 37/065
10,030,640 B2 * 7/2018 Oikawa ..... F04B 37/085
11,111,910 B2 * 9/2021 Anantharaman ..... F04B 37/085
11,466,673 B2 * 10/2022 Bartlett ..... F04B 37/08
2009/0165469 A1 * 7/2009 Matsubara ..... F04B 37/08 62/55.5
2009/0266088 A1 * 10/2009 Oikawa ..... B01D 8/00 62/55.5
2010/0000235 A1 * 1/2010 Tanaka ..... F04B 37/08 62/55.5
2013/0008189 A1 * 1/2013 Fukuda ..... F04B 37/08 29/890.035
2014/0174108 A1 * 6/2014 Oikawa ..... F04B 41/06 62/55.5
2014/0260338 A1 * 9/2014 Kimura ..... F04B 37/08 62/55.5
2015/0107273 A1 * 4/2015 Anantharaman ..... F04B 37/085 62/55.5
2020/0105496 A1 * 4/2020 Li ..... F04D 19/042
2021/0079522 A1 * 3/2021 Wu ..... C23C 16/4402
2022/0028707 A1 1/2022 Lin et al.

FOREIGN PATENT DOCUMENTS

CN 1214638 4/1999
CN 1214638 A * 4/1999 ..... F04B 37/02
CN 101469689 A 7/2009
CN 108105066 6/2018
CN 108105066 A * 6/2018 ..... F04B 37/08
CN 207847882 U * 9/2018
CN 111120255 A * 5/2020 ..... F04B 37/08
DE 2455712 8/1976
DE 2455712 A1 * 8/1976
EP 0276346 8/1988
EP 0276346 A1 * 8/1988 ..... F04B 37/08
EP 0603180 B1 * 5/1997 ..... F04B 37/08
FR 2471498 6/1981
FR 2471498 A1 * 6/1981 ..... F04B 37/08
FR 2777951 A1 * 10/1999 ..... F04B 37/08
GB 1201008 8/1970
GB 1201008 A * 8/1970 ..... F04F 9/00
IL 71730 A * 8/1988 ..... F04B 37/08
IL 75222 A * 10/1989 ..... F04B 37/08
JP S61178500 U * 11/1986
JP H037587 2/1991
JP H037587 Y2 * 2/1991
JP H10121224 A * 5/1998 ..... C23C 14/56
JP H11166477 A * 6/1999
JP 2000161214 6/2000
JP 2000161214 A * 6/2000 ..... F04B 39/121
JP 3062706 7/2000
JP 3062706 B2 * 7/2000
JP 4673904 B2 * 4/2011 ..... B01J 3/02
JP 2011168825 A * 9/2011
JP 5123103 1/2013
JP 5123103 B2 * 1/2013
JP 5184995 B2 * 4/2013 ..... F04B 37/08
JP 2015501901 A * 1/2015 ..... F04B 37/08
JP 6253464 B2 * 12/2017 ..... F04B 37/085
KR 20010033946 A * 4/2001 ..... H10P 72/0468
KR 20120030945 A * 3/2012 ..... H10P 95/00
KR 20220164842 A * 12/2022 ..... F04B 37/08
TW 201538855 A * 10/2015 ..... H01J 41/20
WO 9305294 3/1993
WO WO-9305294 A1 * 3/1993 ..... F04B 37/08
WO 2019168014 9/2019
WO WO-2019168014 A1 * 9/2019 ..... F04B 37/02
WO 2022190760 9/2022
WO WO-2022190760 A1 * 9/2022 ..... F25B 9/145

* cited by examiner

CRYOGENIC PUMP FOR SEMICONDUCTOR PROCESSING

CROSS-REFERENCE TO RELATED APPLICATIONS

This patent application is a divisional application of U.S. Non-provisional patent application Ser. No. 18/131,562, filed Apr. 6, 2023, the contents of which are incorporated herein by reference in their entirety.

BACKGROUND

Vacuum systems are widely used in scientific research and industry. Among many important technology fields that need high vacuum systems is the semiconductor manufacturing field. Frequently the performance of devices highly depends on the pressure and impurities present in vacuum systems. Residual gases and/or other impurities in the growth environment could be a significant source of contamination of the product.

Ultra-high vacuum regime is the vacuum regime characterized by pressure lower than $10^{-9}$ Torr and is not trivial to achieve. Though pumps can continuously remove particles from a vacuum chamber to further decrease the pressure in the vacuum chamber, gases may still enter the vacuum chamber by surface desorption from the chamber walls and/or permeation through the walls. Especially when pressure is low, the pressure difference between the inside of the vacuum chamber and the ambient environment, outside the vacuum chamber, makes permeation a more serious issue.

Cryogenic pumps are one type of vacuum device that can be used to attempt to achieve ultra-high vacuum conditions by removing gases from a sealed vacuum chamber at low temperature. Cryogenic pumps trap particles by condensing the particles on a cold surface.

Embodiments of the present disclosure relate to apparatus and methods for improving the efficiency of cryogenic pumps, such as by enhancing molecular capture rate.

BRIEF DESCRIPTION OF THE DRAWINGS

Aspects of the present disclosure are best understood from the following detailed description when read with the accompanying FIGURES. It is noted that, in accordance with the standard practice in the industry, various features are not drawn to scale. In fact, the dimensions of the various features may be arbitrarily increased or reduced for clarity of discussion.

DETAILED DESCRIPTION

Figure 1:
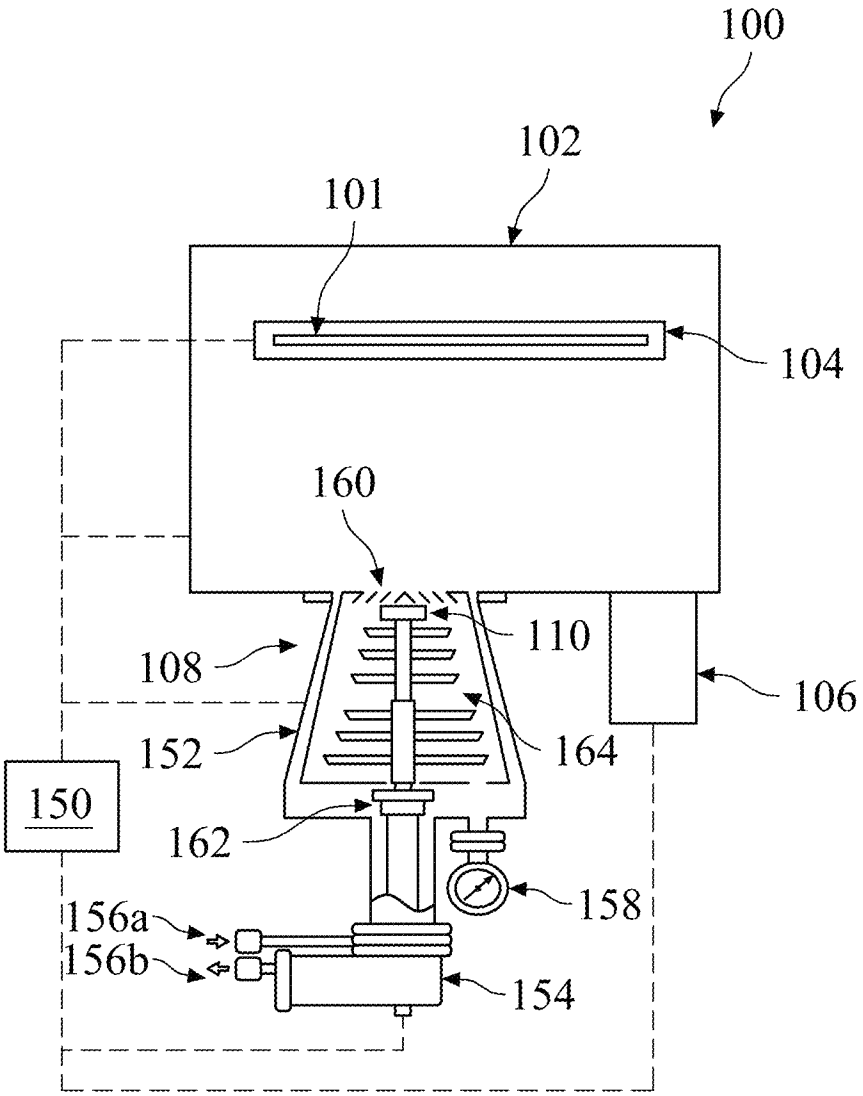
FIG. 1 is a schematic illustration of an example semiconductor processing system according to embodiments of the present disclosure.

The following disclosure provides many different embodiments, or examples, for implementing different features of the provided subject matter. Specific examples of components and arrangements are described below to simplify the present disclosure. These are, of course, merely examples and are not intended to be limiting. For example, the formation of a first feature over or on a second feature in the description that follows may include embodiments in which the first and second features are formed in direct contact, and also may include embodiments in which additional features may be formed between the first and second features, such that the first and second features may not be in direct contact. In addition, the present disclosure may repeat reference numerals and/or letters in the various examples. This repetition is for the purpose of simplicity and clarity and does not in itself dictate a relationship between the various embodiments and/or configurations discussed.

Further, spatially relative terms, such as "beneath," "below," "lower," "above," "over," "top," "upper" and the like, may be used herein for ease of description to describe one element or feature's relationship to another element(s) or feature(s) as illustrated in the FIGURES. The spatially relative terms are intended to encompass different orientations of the device in use or operation in addition to the orientation depicted in the FIGURES. The apparatus may be otherwise oriented (rotated 90 degrees or at other orientations) and the spatially relative descriptors used herein may likewise be interpreted accordingly.

The foregoing broadly outlines some aspects of embodiments described in this disclosure. A person having ordinary skill in the art will readily understand other modifications that may be made are contemplated within the scope of this disclosure. In addition, although method embodiments may be described in a particular order, various other method embodiments may be performed in any logical order and may include fewer or more steps than what is described herein.

FIG. 1 is a schematic illustration of an example semiconductor processing system 100 according to embodiments of the present disclosure. The system 100 may be any suitable type of system or apparatus configured for processing a semiconductor substrate 101. The system 100 includes a process chamber 102 having an access door 104, a vacuum pump 106 coupled to the process chamber 102, a cryogenic pump 108 (shown in partial cross-section) coupled to the process chamber 102, a radiation device 110 coupled to the cryogenic pump 108 for regenerating the cryogenic pump 108 between processing cycles and/or vacuum cycles, and a controller 150.

The process chamber 102 may be, or include, a vacuum chamber associated with a process and/or apparatus such as extreme ultraviolet (EUV) lithography, physical vapor deposition (PVD), atomic layer deposition (ALD), chemical vapor deposition (CVD), an etch process, a transfer room, a buffer room, an attached/hooked chamber in a multi-chamber structure, an implanter tool, and/or a measurement tool, among other examples.

When the access door 104 is open, the process chamber 102 is configured for loading or unloading the semiconductor substrate 101 into or out of the process chamber 102. As shown in FIG. 1, the access door 104 is located on a lateral side of the process chamber 102 and having a landscape orientation for loading a substrate 101 into the process chamber 102 in a lateral, or horizontal direction. In some embodiments, the location and orientation of the access door 104 may differ from what is shown in FIG. 1. When the access door 104 is closed, an interior of the process chamber 102 is sealed off from an outside ambient environment.

The vacuum pump 106 may be, or include, a turbo vacuum pump or another pump capable of maintaining a vacuum, in the process chamber 102, of about $10^{-3}$ Torr or less, such as within a range of between about $10^{-3}$ Torr and about $10^{-6}$ Torr. The cryogenic pump 108, described in more detail below, is configured to create a vacuum, in the process chamber 102, below the pressure capability of the vacuum pump 106. For example, the vacuum pump 106 and the cryogenic pump 108 may be coupled to separate ports (e.g., defined in a body of the process chamber 102) that provide fluid communication with the interior of the process chamber 102. In some embodiments, multiple vacuum pumps 106 and/or multiple cryogenic pumps 108 may be used to achieve a certain vacuum level more quickly than would be achieved with a single pump.

The cryogenic pump 108 may include an outer housing 152 (which also may be referred to herein as a "pump case") that surrounds an interior volume and a cryocooler 154 coupled to the outer housing 152. The cryocooler 154 may be configured to cool the cryogenic pump 108 (e.g., by absorbing heat from the interior and/or from one or more components of the cryogenic pump 108) to lower the temperature to a threshold level. The cryocooler 154 may utilize a refrigerant (e.g., compressed helium and/or liquid nitrogen, among other examples) to provide cooling. The refrigerant may be supplied to the cryocooler 154 through refrigerant input 156*a* and returned from the cryocooler 154 through refrigerant output 156*b*.

The cryogenic pump 108 may include one or more sensors (e.g., one or more temperature sensors and/or pressure sensors, among other examples) in fluid communication with the interior volume for monitoring one or more operational parameters (e.g., operating temperature and/or operating pressure) of the cryogenic pump 108. For example, a temperature gauge 158 may be coupled to the outer housing 152 to monitor a current temperature of the interior volume and/or a temperature of a gas phase within the interior volume.

The cryogenic pump 108 may include a baffle 160 disposed between the respective port defined in the body of the process chamber 102 and the interior volume of the cryogenic pump 108. The cryogenic pump 108 may include a first cold stage 162 within a lower portion of the outer housing 152 and a second cold stage 164 within an upper portion of the outer housing 152 (e.g., between the first cold stage 162 and the baffle 160).

The radiation device 110 may be disposed within the upper portion of the outer housing 152 (e.g., adjacent to the baffle 160 and/or between the baffle 160 and the second cold stage 164). The radiation device 110 may be, or include, an infrared (IR) device, a near-infrared (NIR) device, a mid-infrared (MIR) device, a far-infrared (FIR) device, an ultraviolet (UV) device, a light emitting diode (LED) device, a light emitting element with filament, a light emitting element with gas, a reflection element, a refraction element, and/or a thermal radiation device, among other examples. The radiation device 110 may be configured to cause outgassing of gas particles (which also may be referred to herein as "gas molecules") that are captured in the cryogenic pump 108.

The controller 150 is in communication (e.g., via a wired connection or a wireless connection) with the controllable components of the system 100, including, for example, the cryogenic pump 108 (e.g., one or more components of the cryogenic pump 108). The controller 150 also may be in communication with the process chamber 102, the access door 104, the vacuum pump 106, and/or the radiation device 110. The controller 150 may include one or more memories, one or more processors, and/or one or more communication components. The controller 150 (e.g., the one or more processors) may be configured to perform operations associated with controlling the cryogenic pump 108, as described in more detail in connection with FIG. 4.

Figure 2:
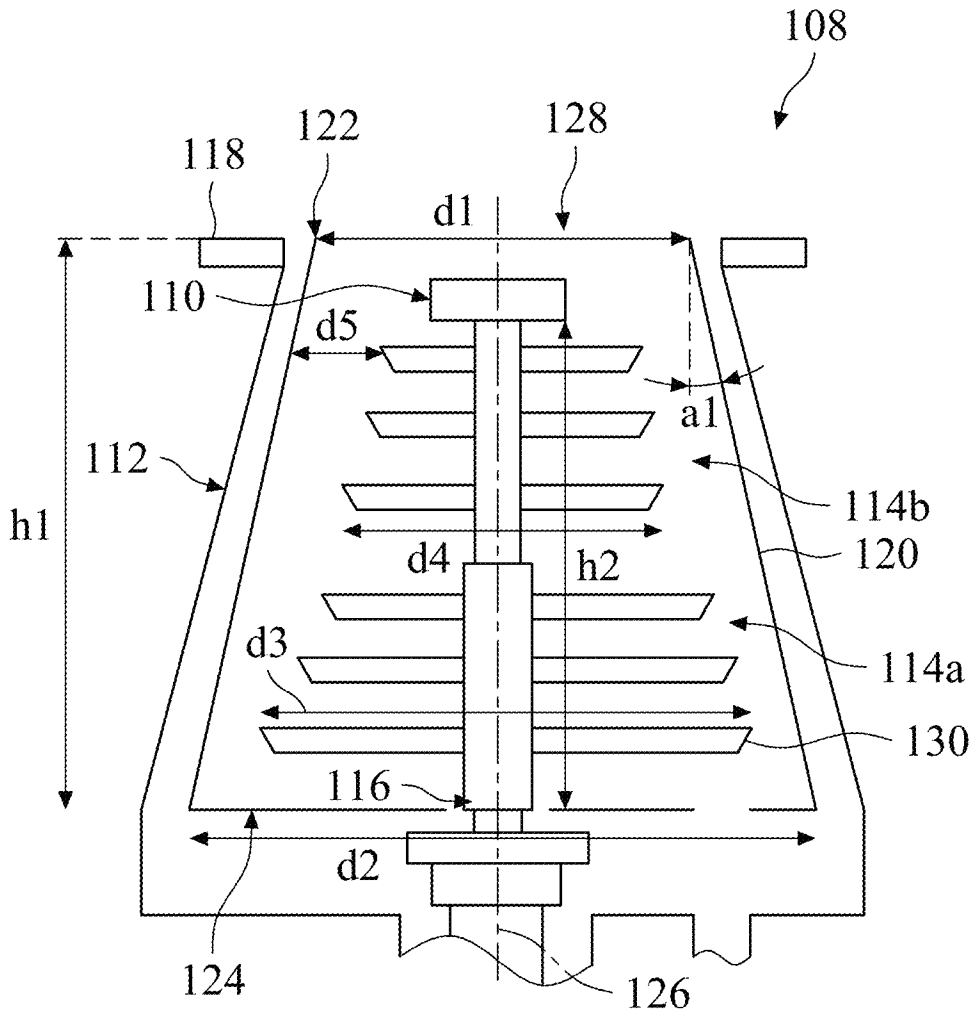
FIG. 2 is a schematic illustration of an example cryogenic pump according to some embodiments of the present disclosure.

FIG. 2 is a schematic illustration of the example cryogenic pump 108 according to some embodiments of the present disclosure. The cryogenic pump 108 includes a body 112, one or more capture plate modules 114 disposed in the body 112, and a cold header 116 thermally coupled to the one or more capture plate modules 114.

The body 112 includes a flange 118 configured to be coupled to the process chamber 102 (as shown in FIG. 1) and sides 120. The sides 120 of the body 112 extend from a first end 122 of the body 112 to a second end 124 of the body 112. A longitudinal axis 126 of the body 112 is defined from the first end 122 to the second end 124. The body 112 includes an opening 128 defined at the first end 122. The opening 128 has a first lateral dimension d1.

In some embodiments, the opening 128 in the body 112 is circular. When the opening 128 is circular, the first lateral dimension d1 corresponds to a diameter of the opening 128. In some embodiments, the opening 128 in the body 112 is elongated (e.g., oval, elliptical, stadium). When the opening 128 is elongated, the first lateral dimension d1 corresponds to a maximum length of the opening 128.

As shown in FIG. 2, the body 112 has a non-cylindrical shape along the longitudinal axis 126. For example, the body 112 may have a conical shape (which also may be referred to herein as a "flask" or "conical flask") with the sides 120 sloping radially outward, in relation to the longitudinal axis 126, in a direction away from the first end 122 and towards the second end 124. The sides 120 of the body 112 slope radially outward at an angle a1. In some embodiments, the angle a1 may be within a range of between about 15 degrees and about 60 degrees, such as about 30 degrees. When molecules trapped in the body 112, during pumping, contact with the sides 120, the slope of the sides 120 increases the chance of the molecules remaining trapped in the body 112, thus, increasing the capture rate.

In some embodiments, the body 112 has an opening 128 that is smaller than a corresponding area of the inner volume, defined by a lateral dimension that is parallel to the opening 128 and between the sides 120 of the body 112, so that gas molecules entering the opening 128 are more likely to stay trapped in the inner volume. For example, the first lateral dimension d1 of the opening 128 may be less than an average lateral dimension of the body 112. As shown in FIG. 2, the first lateral dimension d1 of the opening 128 is less than a second lateral dimension d2 of the body 112. As shown in FIG. 2, the first lateral dimension d1 and second lateral dimension d2 are defined perpendicular to the longitudinal axis 126. As shown in FIG. 2, for example, the second lateral dimension d2 is defined at the second end 124. When the second lateral dimension d2 is defined at the second end 124, a ratio of the second lateral dimension d2 to the first lateral dimension d1 may be greater than or equal to about 1.5, such as within a range of between about 1.5 and about 2 (e.g., 2). In some embodiments, the second lateral dimension d2 may be defined at any position between the opening 128 and the second end 124.

As shown in FIG. 2, the one or more capture plate modules 114 include a pair of fixed capture plate modules 114*a-b*, which include an array of blades 130. The blades 130 are fixedly attached to the cold header 160. The capture plate modules 114*a-b* are stacked along the longitudinal axis 126. In FIG. 2, the fixed blades 130 have a trapezoidal shape (e.g., inverted trapezoid) when viewed in cross-section, and outer radial ends of the fixed blades 130 are sloped in relation to the longitudinal axis 126. In some embodiments, the fixed blades 130 may be rectangular in cross-section, and the outer radial ends may be parallel to the longitudinal axis 126.

As shown in FIG. 2, a first capture plate module 114*a*, having a first outer dimension d3, and a second capture plate module 114*b*, having a second outer dimension d4, together form a profile (which also may be referred to as a "cross-sectional profile" herein) that substantially matches a profile of the sides 120 of the body 112. In other words, an annular gap distance d5 between the one or more capture plate modules 114 and the sides 120 may be substantially constant along the longitudinal axis 126. In FIG. 2, the respective outer dimensions increase in a direction away from the first end 122 and towards the second end 124, such that the first outer dimension d3 is greater than the second outer dimension d4.

As shown in FIG. 2, outer dimensions of individual capture plates modules 114 may have a profile that substantially matches the profile of the sides 120 of the body 112. For example, outer radial ends of the fixed blades 130 that are arrayed in the direction of the longitudinal axis 126 (e.g., stacked along the longitudinal axis 126), may have varying outer dimensions that increase in a direction away from the first end 122 and towards the second end 124. For example, an angle formed by the profile of the individual capture plate modules may be about the same as the angle a1 of the radially outward slope of the sides 120. By matching the profile of the capture plate modules 114 to the shape of the body 112, as described above, a volume of the molecular absorption region (e.g., region 142 in FIG. 10) is increased (e.g., maximized) compared to the corresponding molecular absorption region of capture plate modules 114 with a cylindrical profile, thus, increasing the capture rate of gas molecules in the body 112.

In some embodiments, the profile of the one or more capture plate modules 114 and/or the individual capture plate modules 114 may be different from the profile of the sides 120 of the body 112. For example, the profile of the one or more capture plate modules 114 and/or the individual capture plate modules 114 may be cylindrical, and the profile of the sides 120 of the body 112 may be conical. For example, the first outer dimension d3 of the first capture plate module 114*a* and the second outer dimension d4 of the second capture plate module 114*b* may be substantially equal, whereas the second lateral dimension d2 is greater than the first lateral dimension d1, and the annular gap distance d5 may increase in a direction away from the first end 122 and towards the second end 124.

As shown in FIG. 2, the body 112 has a total height h1, defined from the second end 124 to the opening 128. To fit inside the body 112, a height h2 of the one or more capture plate modules 114 is less than or equal to the total height h1 of the body 112. In some embodiments, a ratio of the height h2 to the total height h1 is within a range of between about 0.8 and about 1 (e.g., 1). In FIG. 2, the cryogenic pump 108 includes only two total capture plate modules 114. As additional capture plate modules 114 are added (e.g., three total capture plate modules 114 in FIG. 6 and four total capture plate modules 114 in FIGS. 7-8), the height h2 may remain the same. In other words, the height h2 may be independent of the total number of capture plate modules 114. To achieve this, individual heights of one or more of the capture plate modules 114 may decrease and/or at least a portion of the individual capture plate modules 114 may be positioned closer together along the longitudinal axis 126 compared to what is shown in FIG. 2. By adapting the size and/or spacing of the capture plate modules 114 to the total height h1, as described above, the cryogenic pump 108 is configured to be fit for purpose based on the operative semiconductor process, thus, improving the efficiency of the cryogenic pump 108.

Figure 3B:
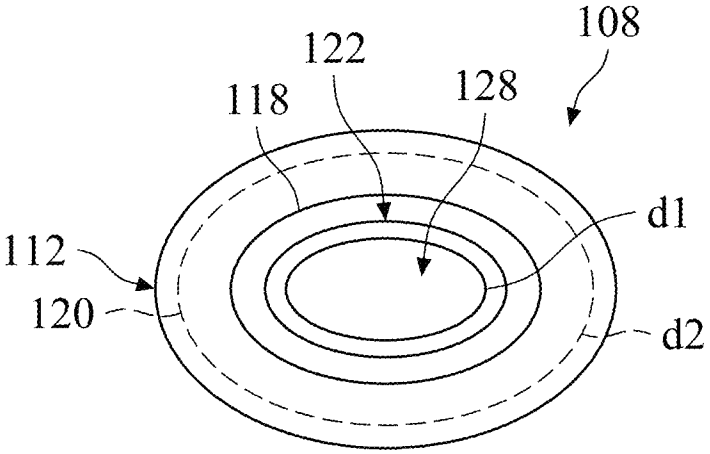
FIGS. 3A and 3B are example top views of the cryogenic pump of FIG. 2 according to some embodiments of the present disclosure.
Figure 3A:
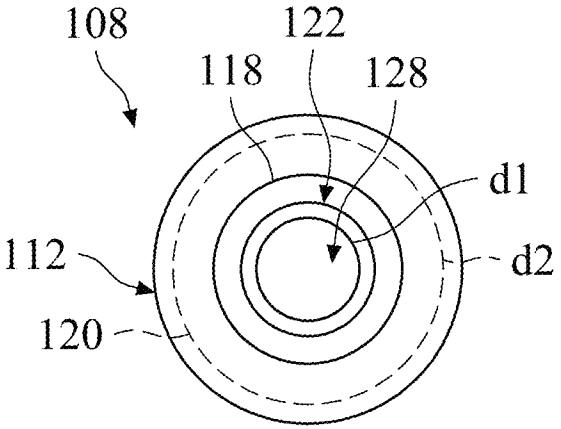

FIGS. 3A and 3B are example top views of the cryogenic pump 108 of FIG. 2 according to some embodiments of the present disclosure. In FIG. 3A, the cryogenic pump 108 has a circular (e.g., round) profile when viewed from the top (e.g., from the first end 122). For example, the body 112, the opening 128 in the body 112, and/or the sides 120 may be circular. In FIG. 3A, the first lateral dimension d1 corresponds to the diameter of the opening 128, and the second lateral dimension d2 corresponds to a diameter of the second end 124. In FIG. 3B, the cryogenic pump 108 has a non-circular (e.g., elongated, oval, elliptical, stadium) profile when viewed from the top (e.g., from the first end 122). For example, the body 112, the opening 128 in the body 112, and/or the sides 120 may be non-circular. In FIG. 3B, the first lateral dimension d1 corresponds to the maximum length of the opening 128, and the second lateral dimension d2 corresponds to a maximum length of the second end 124.

Figure 4:
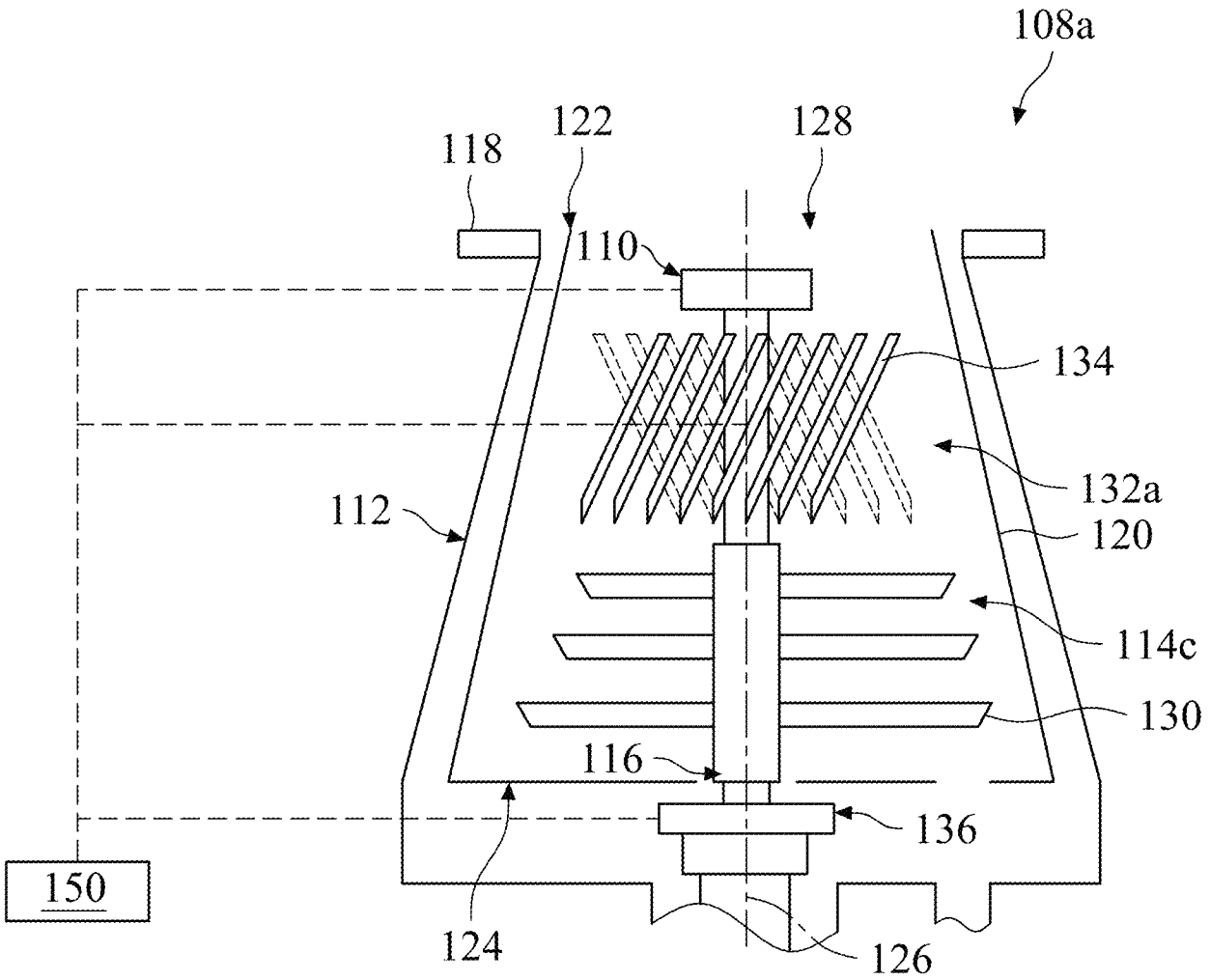
FIG. 4 is a schematic illustration of an example cryogenic pump according to another embodiment of the present disclosure.

FIG. 4 is a schematic illustration of an example cryogenic pump 108*a* according to another embodiment of the present disclosure. As shown in FIG. 4, the cryogenic pump 108*a* includes a fixed capture plate module 114*c* and a movable capture plate module 132*a*. The fixed capture plate module 114*c* is positioned between the movable capture plate module 132*a* and the second end 124. In some embodiments, the positions of the capture plate modules 114*c*, 132*a* may differ from what is shown in FIG. 4. For example, the movable capture plate module 132*a* may be positioned between the fixed capture plate module 114*c* and the second end 124.

The movable capture plate module 132*a* includes an array of movable blades 134 and a drive mechanism 136 configured to drive the movable blades 134 relative to the cold header 116. The movable blades 134 may be movable via vibration, rotation, and/or tilting, among other examples. The drive mechanism 136 may be coupled to the movable blades 134 directly or may be configured to drive the movable blades 134 indirectly (e.g., via the cold header 116). In some embodiments, the drive mechanism 136 may include a drive motor, belt drive, chain drive, gear drive, vibration drive, a vibrometer, exciter mechanism, and/or a V-belt transmission, among other examples.

An example of tilting movement is illustrated in FIG. 4. The array of movable blades 134 may transition from a first position (shown in solid lines) to a second position (shown in dotted lines). This movement provides important advantages, for example causing an increase in the effective surface area of the movable blades 134, compared to the fixed blades 130, which may result in higher molecular capture rates for the cryogenic pump 108*a*. The tilting movement is described in more detail in connection with FIG. 5.

In some embodiments, the movable blades 134 may be movable via vibration. For example, the vibration rate may be about 20 Hz or less, such as within a range of between about 10 Hz and about 20 Hz (e.g., 20 Hz). The vibration rate also may be measured herein in units of "beats per minute (bpm)". For example, the vibration rate of the movable blades 134 may be about 1000 bpm or less, such as within a range of between about 500 bpm and about 1000 bpm (e.g., 1000 bpm).

In some embodiments, the movable blades 134 may be movable via rotation. For example, the rotation rate may be about 1000 rpm or less, such as within a range of between about 500 rpm and about 1000 rpm (e.g., 1000 rpm). In some embodiments, a direction of the rotation may be clockwise and/or counterclockwise. In some embodiments, the movable capture plate module 132*a* may be movable at periodic time intervals. For example, the time intervals between periodic movements of the capture plate module 132*a* and/or the movable blades 134 of the capture plate module 132*a* may occur on a relatively short time scale (e.g., in relation to vacuum cycle time). For example, the time intervals may be about 1 second or less, such as within a range of between about 100 milliseconds and about 1 second (e.g., 100 milliseconds). When moving within the body 112, the movable capture plate modules 132 introduce turbulence/flow in the body 112, thus, increasing capture rate of gas molecules in the body 112.

The controller 150 may include one or more memories, one or more processors, and/or one or more communication components. The one or more processors may include a central processing unit (CPU), a graphics processing unit (GPU), a microprocessor, a digital signal processor and/or other processing units or components. In some embodiments, the functionality described herein can be performed, at least in part, by one or more hardware logic components. For example, illustrative types of hardware logic components that may be used include field-programmable gate arrays (FPGAs), application-specific integrated circuits (ASICs), application-specific standard products (ASSPs), system-on-a-chip systems (SOCs), and complex programmable logic devices (CPLDs), among other examples. In some embodiments, the one or more processors may possess their own local memory, which also may store program modules, program data, and/or one or more operating systems.

The one or more memories may be non-transitory computer-readable media that may include volatile and/or non-volatile memory, removable and/or non-removable media implemented in any method or technology for storage of information, such as computer-readable instructions, data structures, program modules, or other data. Such memory may include random access memory (RAM), read-only memory (ROM), electrically erasable programmable read-only memory (EEPROM), flash memory or other memory technology, or any other medium which can be used to store the desired information, and which can be accessed by a computing device. The one or more memories may be implemented as computer-readable storage media (CRSM), which may be any available physical media accessible by the one or more processors to execute instructions stored on the one or more memories. The one or more memories may have an operating system and/or a variety of suitable applications stored thereon. The operating system, when executed by the one or more processors, may enable management of hardware and/or software resources of the controller 150.

The controller 150 (e.g., the one or more processors) may be configured to perform operations associated with controlling the cryogenic pump 108*a*. For example, the controller 150 may control the movable capture plate module 132*a*, the array of movable blades 134, and/or the drive mechanism 136. In some embodiments, the controller 150 may cause vibration, rotation, and/or tilting movement of the movable blades 134 (e.g., via the drive mechanism 136). For example, the controller 150 may cause the transition of the array of movable blades 134 from the first position (shown in solid lines) to the second position (shown in dotted lines). In some embodiments, the controller 150 may cause vibration of the movable blades 134 at a desired vibration rate. For example, the vibration rate may be predetermined and/or dynamically determined based on information of the system 100. In some embodiments, the controller 150 may cause rotation of the movable blades 134 at a desired rotation rate. For example, the rotation rate may be predetermined and/or dynamically determined based on information of the system 100. The direction of the rotation may be determined and/or changed by the controller 150. In some embodiments, the controller 150 may determine the periodic time intervals for movement of the movable capture plate module 132*a*.

Figure 5:
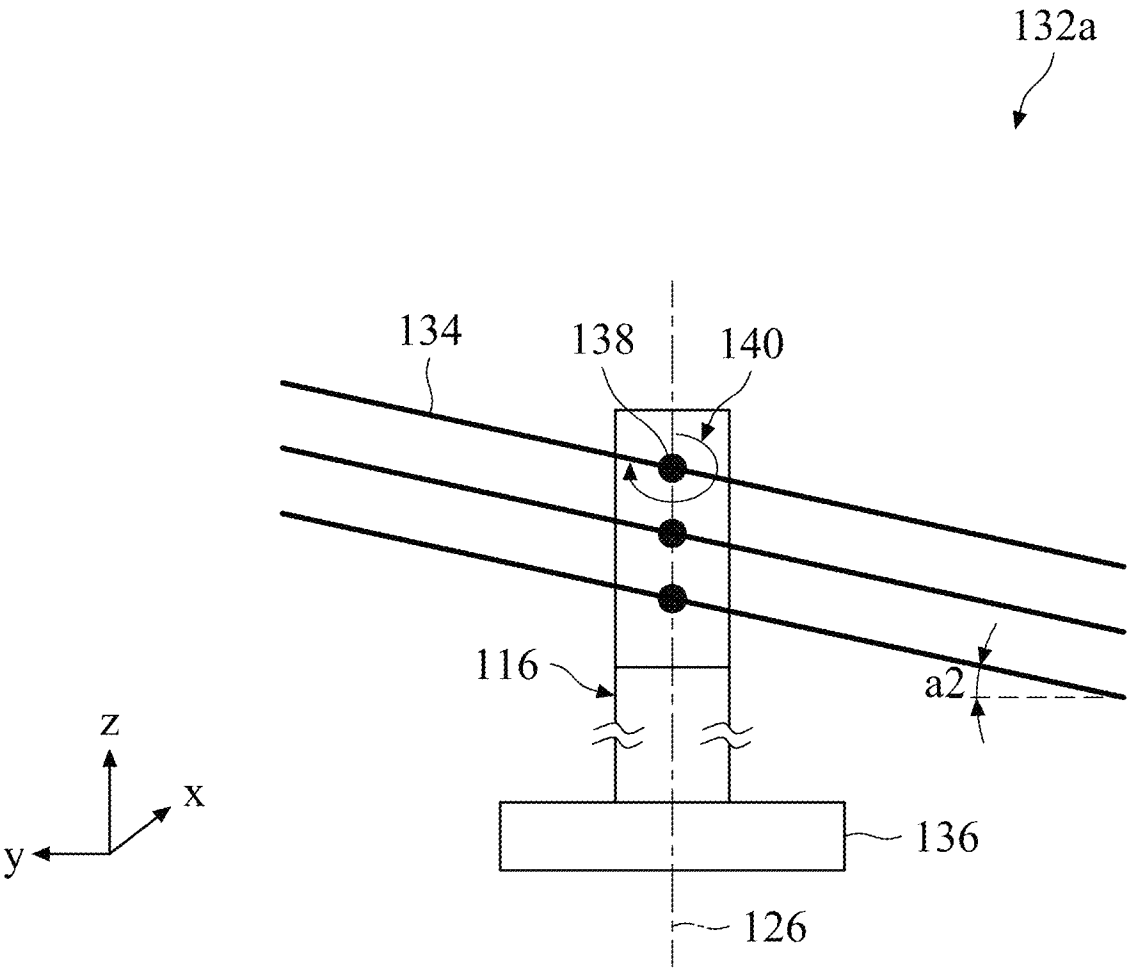
FIG. 5 schematically illustrates the operation of a movable capture plate module according to embodiments of the present disclosure.

FIG. 5 schematically illustrates the operation of the movable capture plate module 132*a* according to embodiments of the present disclosure. As shown in FIG. 5, the movable blades 134 may be movable via tilting. The drive mechanism 136 is configured to drive movement of the movable blades 134. For example, the drive mechanism 136 may be attached to the body 112 (e.g., at the second end 124 of the body 112). As an example, an output shaft of the drive mechanism 136 may extend along the longitudinal axis 126 away from the second end 124 and towards the first end 122 of the body 112 to engage the cold header 116 and/or the moveable capture plate module 132*a*. In another example, the drive mechanism 136 may be attached between the cold header 116 and the movable capture plate module 132*a*, and the output shaft may engage the movable blades 134. The drive mechanism 136 may be coupled either directly or indirectly to the movable blades 134. For example, the drive mechanism 136 may be coupled, independently, to each individual one of the movable blades 134. For example, tilting of each movable blade 134 may be controlled independently (e.g., using the controller 150). The movable blades 134 are configured to tilt about an axis of rotation 138 (which is perpendicular to the longitudinal axis 126 and oriented into the plane of the page). In some embodiments, the movable blades 134 may be configured to tilt independently of one another. In some embodiments, the movable blades 134 may be configured to tilt back-and-forth in a clockwise direction (shown by curved arrow 140 in FIG. 5) and a counterclockwise direction. A tilt angle a2 of the movable blades 134, measured from the y-axis, may be within a range of between about 15 degrees and about 45 degrees (e.g., 30 degrees) in either direction.

Figure 6:
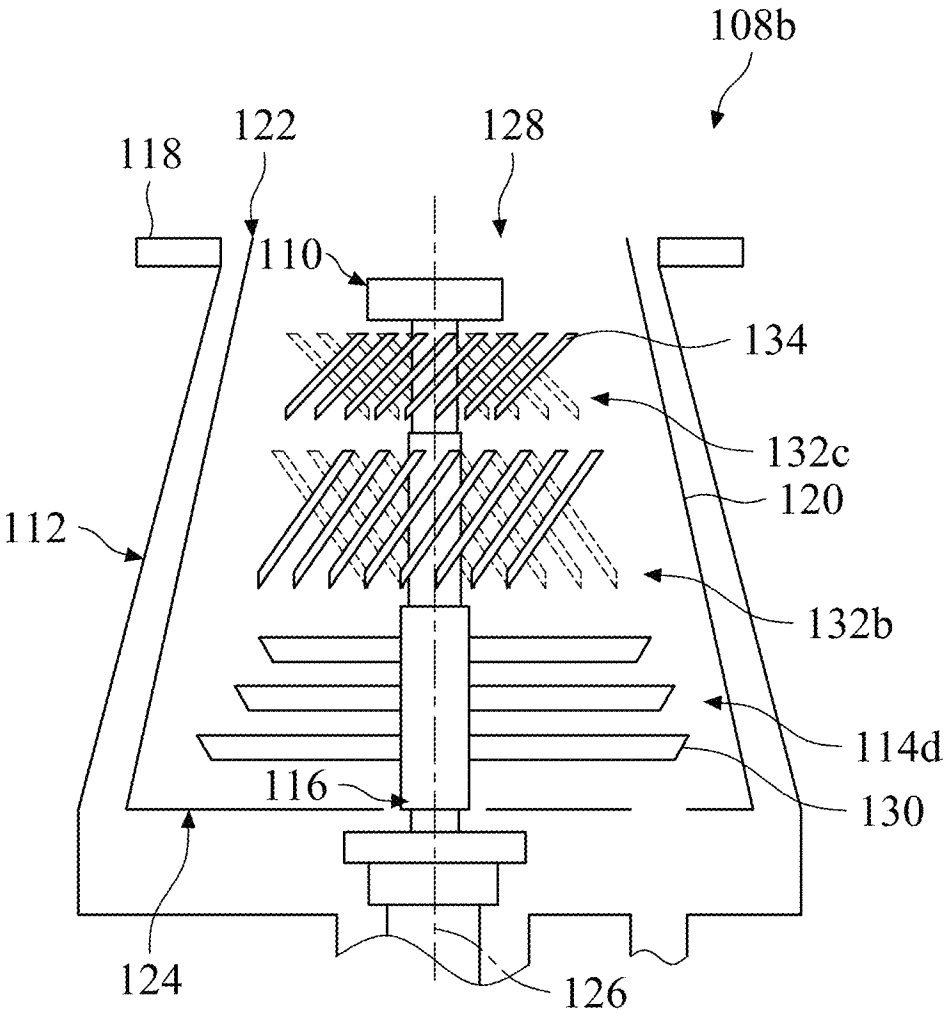
FIG. 6 is a schematic illustration of an example cryogenic pump according to another embodiment of the present disclosure.

FIG. 6 is a schematic illustration of an example cryogenic pump 108*b* according to another embodiment of the present disclosure. As shown in FIG. 6, the cryogenic pump 108*b* includes a fixed capture plate module 114*d* and a pair of movable capture plate modules 132*b-c*. The fixed capture plate module 114*d* is positioned between the pair of movable capture plate module 132*b-c* and the second end 124. In some embodiments, the positions of the capture plate modules may differ from what is shown in FIG. 6.

In some embodiments, the drive mechanism 136 may be configured to drive multiple movable capture plate modules simultaneously (e.g., at the same or different operating conditions). For example, the drive mechanism 136 may be coupled, independently, to each individual one of the pair of movable capture plate modules 132*b-c*. For example, movement of each one of the pair of movable capture plate modules 132*b-c* may be controlled independently (e.g., using the controller 150). In some embodiments, the drive mechanism may include another drive mechanism, or a group of drive mechanisms, separate from the drive mechanism 136 in order to drive multiple movable capture plate modules.

Figure 7:
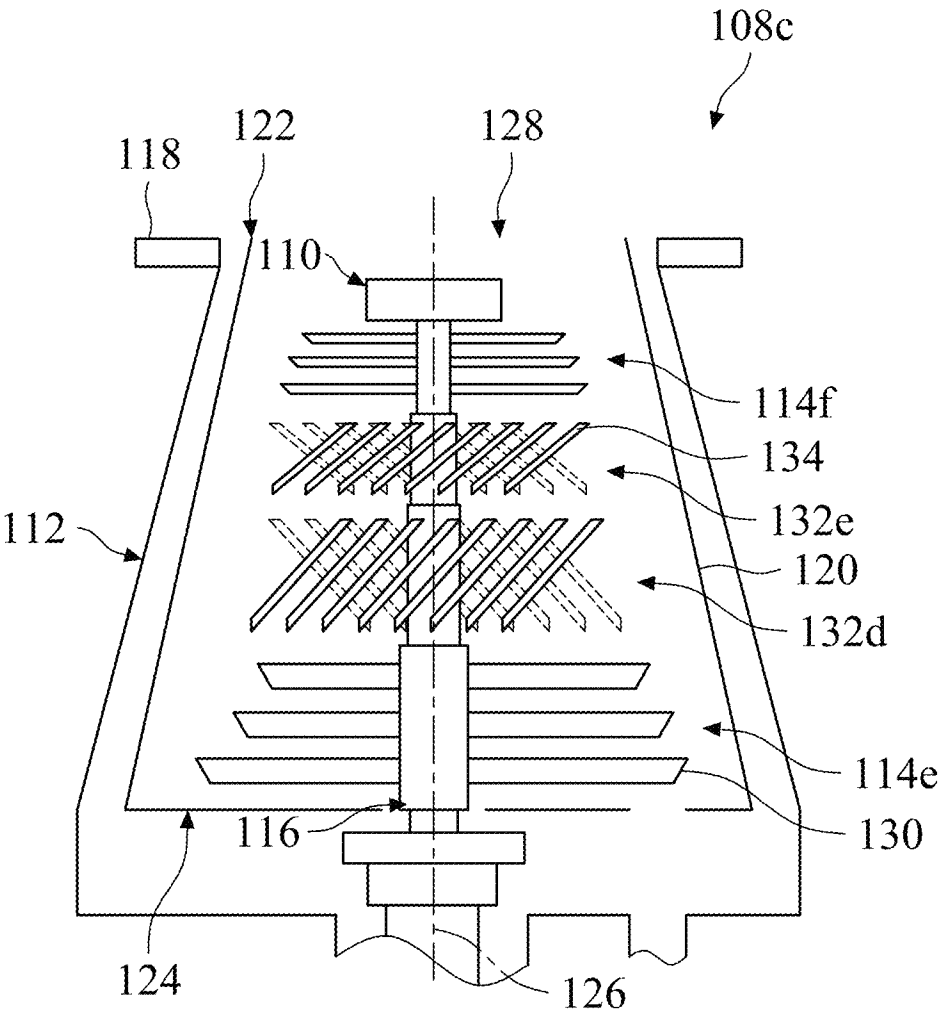
FIG. 7 is a schematic illustration of an example cryogenic pump according to another embodiment of the present disclosure.

FIG. 7 is a schematic illustration of an example cryogenic pump 108*c* according to another embodiment of the present disclosure. As shown in FIG. 7, the cryogenic pump 108*c* includes a pair of fixed capture plate modules 114*e-f* and a pair of movable capture plate modules 132*d-e*. The pair of movable capture plate modules 132*d-e* are positioned between a first fixed capture plate module 114*e* and a second fixed capture plate module 114*f*. In some embodiments, the positions of the capture plate modules may differ from what is shown in FIG. 7.

Figure 8:
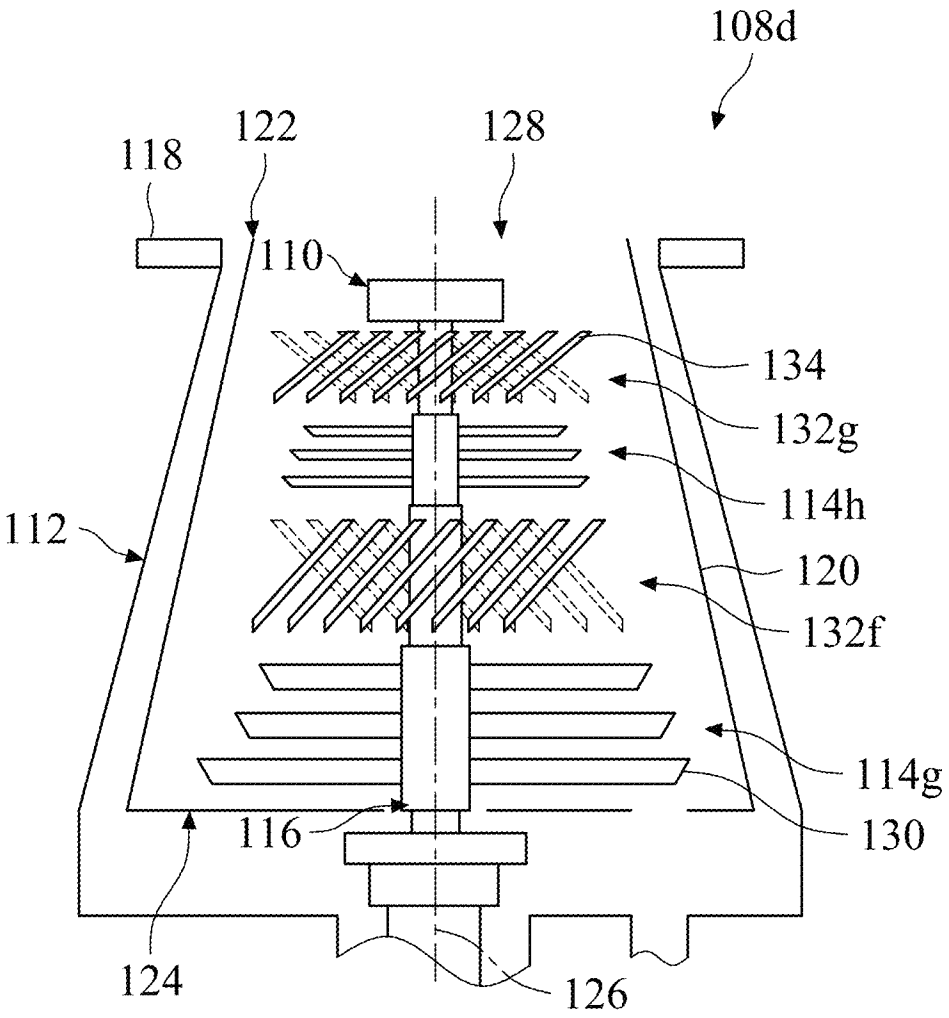
FIG. 8 is a schematic illustration of an example cryogenic pump according to another embodiment of the present disclosure.

FIG. 8 is a schematic illustration of an example cryogenic pump 108*d* according to another embodiment of the present disclosure. As shown in FIG. 8, the cryogenic pump 108*d* includes a pair of fixed capture plate modules 114*g-h* and a pair of movable capture plate modules 132*f-g*. The fixed capture plate modules 114*g-h* and the movable capture plate modules 132*f-g* are arranged in an alternating pattern. In some embodiments, the positions of the capture plate modules may differ from what is shown in FIG. 8.

Figure 9:
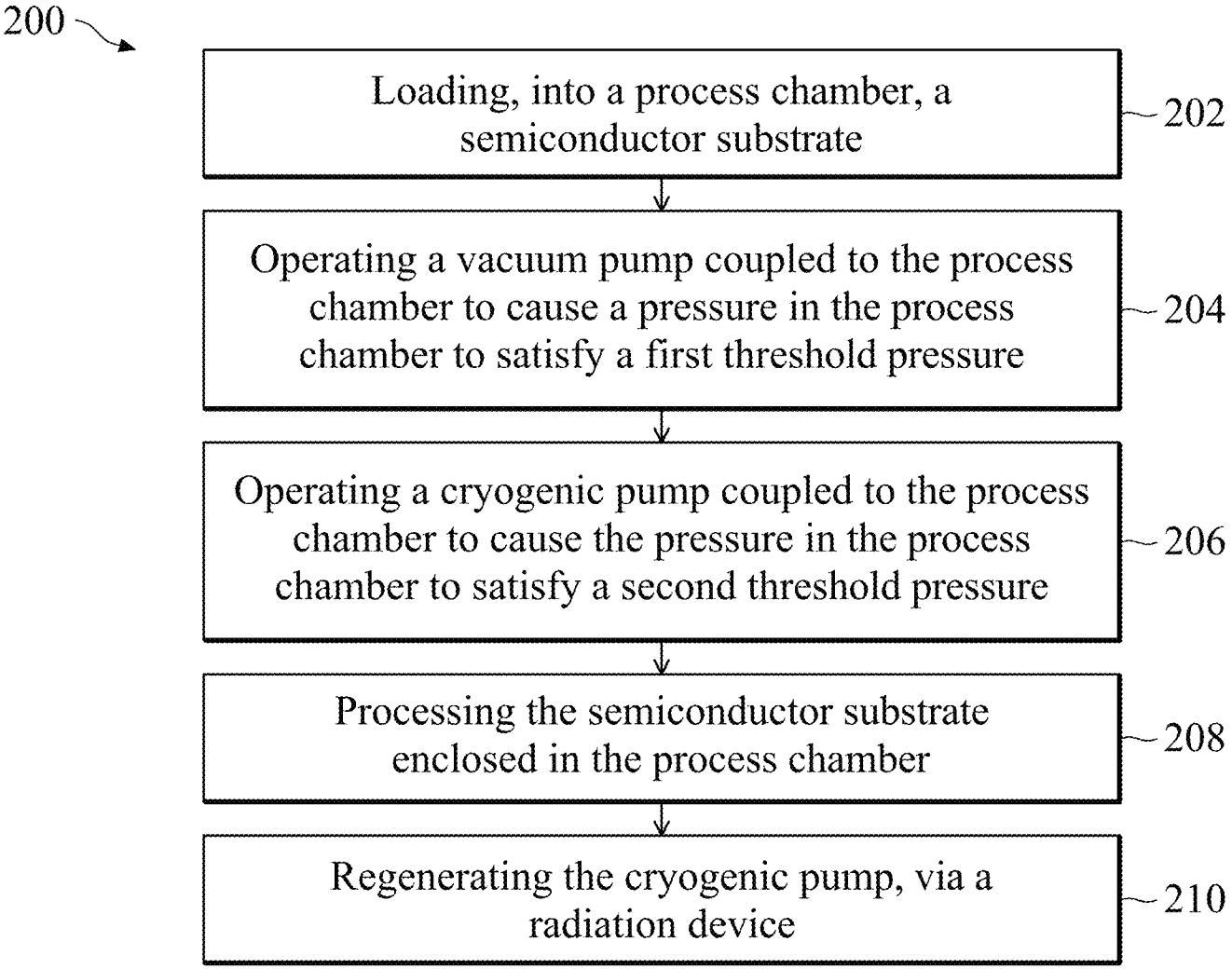
FIG. 9 is a flow chart of an example method for processing a semiconductor substrate according to embodiments of the present disclosure.

FIG. 9 is a flow chart of an example method 200 for processing a semiconductor substrate according to embodiments of the present disclosure. The method 200 may be associated with operation of a cryogenic pump of a semiconductor processing system. One or more process blocks of FIG. 9 may be performed by a controller (e.g., controller 150). In some embodiments, one or more process blocks of FIG. 9 may be performed by another device or a group of devices separate from or including the controller, such as another device or component that is internal or external to the semiconductor processing system 100. In some embodiments, one or more process blocks of FIG. 9 may be performed by one or more components of a device, such as a processor, a memory, an input component, an output component, and/or a communication component. In some embodiments, additional process blocks may be provided before, during, and after the example blocks in FIG. 9, and some of the process blocks of FIG. 9 may be replaced or eliminated. The order of the process blocks may be interchangeable.

As shown in FIG. 9, at block 202 to start the method 200, a process chamber (e.g., process chamber 102) is loaded with a substrate to be processed. For example, loading the substrate into the process chamber may include opening and/or closing an access door for the process chamber, transferring the semiconductor substrate into the process chamber through the open access door (e.g., using a robot handling arm), and/or sealing an interior of the process chamber against a pressure of the ambient environment. For example, the pressure of the ambient environment may be equal to atmospheric pressure, or about 760 Torr.

In some embodiments, the substrate may be, or include, a crystalline silicon substrate (e.g., wafer). The substrate may be a p-type substrate, doped with p-type dopants, or an n-type substrate, doped with n-type dopants. In some embodiments, the substrate may be a silicon on insulator (SOI) substrate. Generally, an SOI substrate has a layer of a semiconductor material formed on an insulator layer. The insulator layer may be, for example, a buried oxide (BOX) layer, a silicon oxide layer, or the like. The insulator layer is provided on a substrate, typically a silicon or glass substrate. Other substrates, such as a multi-layered or gradient substrates also may be used. In some embodiments, the semiconductor material of the substrate may include silicon; germanium; a compound semiconductor including silicon carbide, gallium arsenide, gallium phosphide, indium phosphide, indium arsenide, and/or indium antimonide; an alloy semiconductor including silicon-germanium, gallium arsenide phosphide, aluminum indium arsenide, aluminum gallium arsenide, gallium indium arsenide, gallium indium phosphide, and/or gallium indium arsenide phosphide; or combinations thereof. In some embodiments, the semiconductor substrate may be, or include, planar FETs, Fin-FETs, Horizontal Gate All Around (HGAA) FETs, Vertical Gate All Around (VGAA) FETs, and/or nanosheet channel FETs, among other substrates.

As further shown in FIG. 9, at block 204 of the method 200, a vacuum pump, coupled to the process chamber, is operated to cause a pressure in the process chamber to satisfy a first threshold pressure. For example, an initial value of the pressure in the process chamber may be greater than the first threshold pressure (e.g., about 760 Torr). The vacuum pump may be activated to the lower the pressure in the process chamber relative to the initial pressure. In some embodiments, the vacuum pump may be operated continuously. Operation of the vacuum pump may continue at least until the pressure in the process chamber is equal to the first threshold pressure. In some embodiments, operation of the vacuum pump may continue until the pressure in the process chamber is less than the first threshold pressure. In some embodiments, the first threshold pressure may be about $10^{-3}$ Torr, and the vacuum pump may be operated at least until the pressure in the process chamber is less than or equal to $10^{-3}$ Torr. In some embodiments, the first threshold pressure may be within a range of between about $10^{-3}$ Torr and about $10^{-6}$ Torr.

As further shown in FIG. 9, at block 206 of the method 200, a cryogenic pump (e.g., cryogenic pump 108), coupled to the process chamber, is operated to cause the pressure in the process chamber to satisfy a second threshold pressure. The second threshold pressure is less than the first threshold pressure. For example, at the start of block 206, a value of the pressure in the process chamber may be greater than the second threshold pressure. For example, the starting value of the pressure in the process chamber may be less than or equal to the first threshold pressure (e.g., 5%, 10%, or the like, less than the first threshold pressure). The cryogenic pump may be activated to lower the pressure in the process chamber relative to the starting pressure. In some embodiments, the cryogenic pump may be operated continuously. Operation of the cryogenic pump may continue at least until the pressure in the process chamber is equal to the second threshold pressure. In some embodiments, operation of the cryogenic pump may continue until the pressure in the process chamber is less than the second threshold pressure. In some embodiments, the second threshold pressure may be about $10^{-6}$ Torr, and the cryogenic pump may be operated at least until the pressure in the process chamber is less than or equal to $10^{-6}$ Torr. In some embodiments, the second threshold pressure may be within a range of between about $10^{-6}$ Torr and about $10^{-9}$ Torr.

As further shown in FIG. 9, at block 208 of the method 200, the semiconductor substrate enclosed in the process chamber is processed. The processing may be, or include, EUV lithography, PVD, ALD, CVD, an etch process, and/or ion implantation, among other examples. In some embodiments, the pressure in the process chamber may be maintained at or below the second threshold pressure throughout the processing of the semiconductor substrate at block 208. In some embodiments, the pressure in the process chamber may be maintained within a range of between about $10^{-6}$ Torr and about $10^{-9}$ Torr. In some embodiments, the processing of the semiconductor substrate may be carried out at substantially constant pressure. In some embodiments, the processing of the semiconductor substrate may occur within a time frame of about 10 minutes to about 90 minutes (e.g., 30 minutes). In some embodiments, the processing of the semiconductor substrate may occur within a time frame that is less than a length of time for one or more capture plate modules of the cryogenic pump to become saturated with gas molecules, after which time the vacuum level of the cryogenic pump may be reduced relative to a vacuum capacity of the cryogenic pump.

As further shown in FIG. 9, at block 210 of the method 200, the cryogenic pump is regenerated via a radiation device (e.g., radiation device 110). Regeneration of the cryogenic pump is needed when the one or more capture plates satisfy an upper threshold level of gas molecule saturation. In some embodiments, the upper threshold saturation level may be within a range of between about 95% and about 99% (e.g., 99%). Activation of the radiation device causes outgassing of the captured gas molecules to rapidly lower the saturation level. Operation of the radiation device may continue at least until the saturation level in the cryogenic pump is equal to a lower threshold saturation level. In some embodiments, the lower threshold saturation level may be within a range of between about 1% and about 10% (e.g., 5%). In some embodiments, the radiation device may be part of a high efficiency regeneration module capable of rapidly regenerating the cryogenic pump. For example, the high efficiency regeneration module may be configured to lower the gas molecule saturation from the upper threshold level to the lower threshold level within a time frame of about 20 minutes or less (e.g., 10 minutes).

Although FIG. 9 shows example blocks of the method 200, in some embodiments, the method 200 may include additional blocks, fewer blocks, different blocks, or differently arranged blocks than those depicted in FIG. 9. In some embodiments, two or more of the blocks of the method 200 may be performed in parallel.

Embodiments of the present disclosure provide various advantages over existing technology. Embodiments of the present disclosure using a non-cylindrical shape for the cryogenic pump body improve the efficiency of the cryogenic pump. For example, the efficiency may be improved from enhancement of the molecular capture rate of the cryogenic pump and/or reduction in the molecular escape rate of molecules from within the cryogenic pump, effects which are explained in more detail in connection with FIG. 10.

Figure 10:
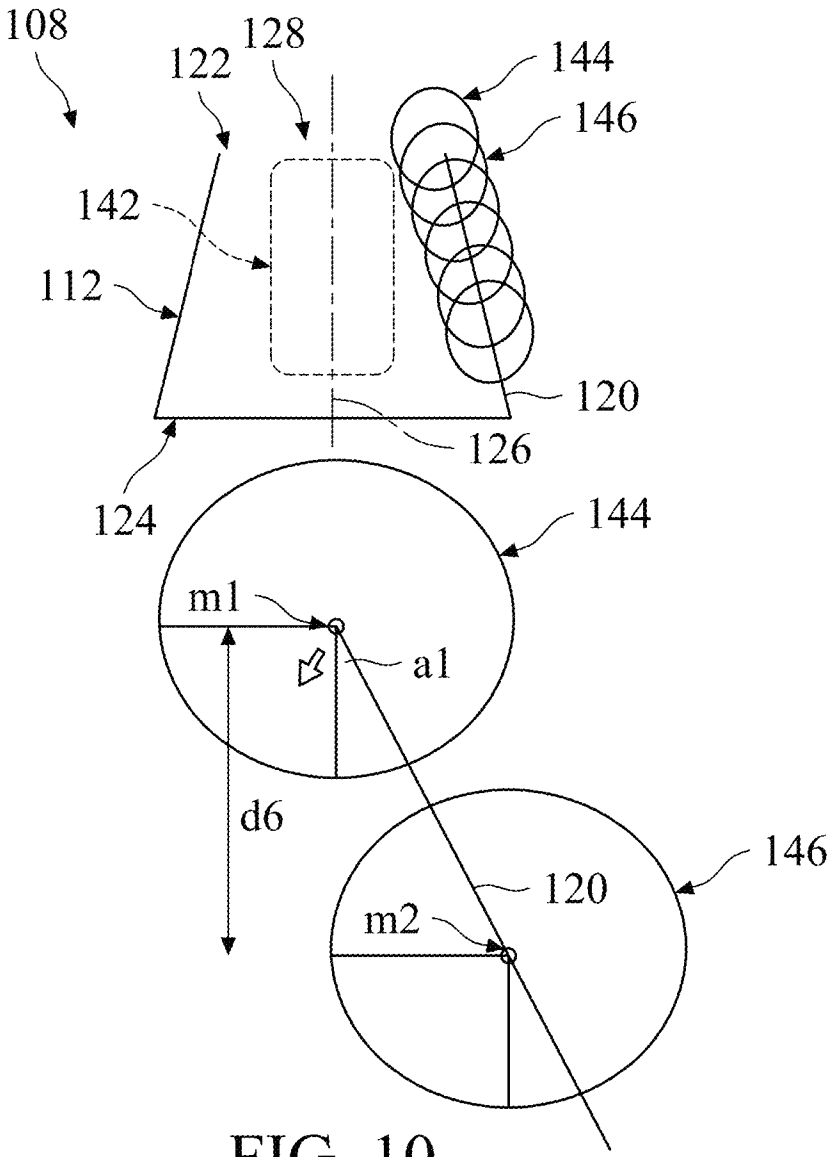
FIG. 10 schematically illustrates the operation of an example cryogenic pump according to embodiments of the present disclosure.

FIG. 10 schematically illustrates the operation of the example cryogenic pump 108 according to embodiments of the present disclosure. Interior components (e.g., cold header and capture plate modules) are omitted from FIG. 10 for clarity. As shown in FIG. 10, the cryogenic pump 108 includes a molecular adsorption region 142, a first body portion 144, and a second body portion 146.

The molecular absorption region 142 may conform to the shape of one or more capture plate modules of the cryogenic pump 108 and/or conform to the shape, or cross-sectional profile, of the body 112 and/or the sides 120 of the cryogenic pump 108. In FIG. 10, as an example, the molecular absorption region 142 is cylindrical. In some embodiments, the molecular absorption region 142 may be non-cylindrical (e.g., conical). In general, the molecular absorption region 142 may correspond to a location within the cryogenic pump 108 where gas molecules may be captured (e.g., corresponding to a position of one or more blades and/or one or more capture plate modules of the cryogenic pump 108).

As shown in FIG. 10, the first body portion 144 corresponds to an upper section of the body 112 of the cryogenic pump 108. For example, the first body portion 144 may include an upper portion of the sides 120 (e.g., including an intersection of the sides 120 and the flange 118 at the first end 122), and/or may be adjacent to the opening 128. In some embodiments, the first body portion 144 may correspond to an intake region of the cryogenic pump 108 (e.g., corresponding to an initial about 5% to about 20%, relative to the total height h1 of the body 112, adjacent to the first end 122).

As shown in FIG. 10, the second body portion 146 corresponds to a middle section of the body 112 of the cryogenic pump 108. For example, the second body portion 146 may include a middle portion of the sides 120 (e.g., adjacent the upper portion of the sides 120 and/or adjacent the intersection of the sides 120 and the flange 118 at the first end 122). In some embodiments, the second body portion 146 may be adjacent to the intake region of the cryogenic pump 108 (e.g., corresponding to a region of the body 112 that is spaced from the first end 122 by about 5% to about 20% relative to the total height h1 of the body 112).

As shown in FIG. 10, a first gas molecule m1 is associated with the first body portion 144 and a second gas molecule m2 is associated with the second body portion 146. The first gas molecule m1 is positioned at the intersection of the sides 120 and the flange 118 at the first end 122. The second gas molecule m2 is positioned a distance d6 from the first end 122. In some embodiments, the distance d6 may be within a range of between about 5% and about 20% of the total height h1 of the body 112. Although the gas molecules appear fixed in place in FIG. 10, as the drawing illustrates a single snapshot in time, in reality the gas molecules are moving and colliding with other gas molecules and with the body 112 of the cryogenic pump 108. Based on this dynamic movement, the first gas molecule m1 and second gas molecule m2 each have a certain chance of moving in a direction that causes the respective gas molecule to stay inside the cryogenic pump 108 and a remaining chance of moving in a direction that causes the respective gas molecule to escape from the cryogenic pump 108.

For example, at the position of the first gas molecule m1, the chance of the first gas molecule m1 staying in the body 112 of the cryogenic pump may be about 40%. At the position of the second gas molecule m2, as an example, the chance of the second gas molecule m2 staying in the body 112 of the cryogenic pump may be about 66%. The respective chances of the first and second gas molecules m1, m2 staying inside the cryogenic pump 108 with a non-cylindrical body 112 are improved relative to a similar cryogenic pump with a cylindrical body. For example, at the position of the first gas molecule m1, the chance of the first gas molecule m1 staying inside a similar cryogenic pump with a cylindrical body may be only about 33%, which corresponds to an improvement of about 20% in terms of the stay-in-pump ratio for the non-cylindrical body compared to the cylindrical body. Furthermore, at the position of the second gas molecule m2, the chance of the second gas molecule m2 staying inside a similar cryogenic pump with a cylindrical body may be only about 50%, which corresponds to an improvement of about 30% in terms of the stay-in-pump ratio for the non-cylindrical body compared to the cylindrical body.

Therefore, using a non-cylindrical shape for the cryogenic pump body provides the advantage of improving the efficiency of the cryogenic pump, at least by improving the molecular stay-in-pump ratio, which in turn may enhance the molecular capture rate of the cryogenic pump and/or reduce the molecular escape rate of molecules from within the cryogenic pump. While the shape of the non-cylindrical body itself achieves this advantage, as described above, another potential factor that improves the pump efficiency is the relatively smaller opening of the non-cylindrical body, compared to the corresponding opening of a cylindrical body with the same size molecular absorption region, as described above.

It will be understood that not all advantages have been necessarily discussed herein, no particular advantage is required for all embodiments or examples, and other embodiments or examples may offer different advantages.

Some embodiments of the present disclosure provide a cryogenic pump for semiconductor processing including a body having a flange, configured to be coupled to a process chamber, and an opening defined at a first end of the body, wherein a longitudinal axis of the body is defined from the first end of the body to a second end of the body, wherein a first lateral dimension of the opening is less than a second lateral dimension of the body, the first and second lateral dimensions being defined perpendicular to the longitudinal axis, and wherein the second lateral dimension is defined at a position between the opening and the second end; one or more capture plate modules disposed in the body; and a cold header thermally coupled to the one or more capture plate modules.

Some embodiments of the present disclosure provide a cryogenic pump for semiconductor processing including a body having a flange, configured to be coupled to a process chamber, and an opening defined at a first end of the body, wherein a longitudinal axis of the body is defined from the first end of the body to a second end of the body, and wherein the body has a non-cylindrical shape with sides sloping radially outward, in relation to the longitudinal axis, in a direction away from the first end and towards the second end; one or more capture plate modules disposed in the body; and a cold header thermally coupled to the one or more capture plate modules.

Some embodiments of the present disclosure provide a method for semiconductor processing including loading, into a process chamber, a semiconductor substrate; operating a cryogenic pump coupled to the process chamber to cause a pressure in the process chamber to satisfy a first threshold pressure, the cryogenic pump including: a body having a flange, coupled to the process chamber, and an opening defined at a first end of the body, wherein a longitudinal axis of the body is defined from the first end of the body to a second end of the body, and wherein the body has a conical non-cylindrical shape with sides sloping radially outward, in relation to the longitudinal axis, in a direction away from the first end and towards the second end; and processing the semiconductor substrate enclosed in the process chamber.

The foregoing outlines features of several embodiments so that those skilled in the art may better understand the aspects of the present disclosure. Those skilled in the art should appreciate that they may readily use the present disclosure as a basis for designing or modifying other processes and structures for carrying out the same purposes and/or achieving the same advantages of the embodiments introduced herein. Those skilled in the art should also realize that such equivalent constructions do not depart from the spirit and scope of the present disclosure, and that they may make various changes, substitutions, and alterations herein without departing from the spirit and scope of the present disclosure.

The invention claimed is:

1. A method for semiconductor processing, comprising:

loading, into a process chamber, a semiconductor substrate;

operating a cryogenic pump coupled to the process chamber to cause a pressure in the process chamber to satisfy a first threshold pressure, the cryogenic pump including:

a body having a flange, coupled to the process chamber, and an opening defined at a first end of the body; and a first capture plate module and a second capture plate module disposed in the body, wherein a longitudinal axis of the body is defined from the first end of the body to a second end of the body, wherein the body has a non-cylindrical shape with a circumferential side of the body that slopes radially outward, in relation to the longitudinal axis, in a direction away from the first end and towards the second end, and wherein operating the cryogenic pump comprises fixing the first capture plate module in position and moving the second capture plate module; and processing the semiconductor substrate enclosed in the process chamber.

2. The method of claim 1, further comprising:

operating a turbo vacuum pump, coupled to the process chamber, before operating the cryogenic pump, to cause the pressure in the process chamber to satisfy a second threshold pressure that is greater than the first threshold pressure; and regenerating the cryogenic pump, via a radiation device, after the processing of the semiconductor substrate.

3. The method of claim 2, wherein the radiation device is selected from the group consisting of: an infrared (IR) device, a near-infrared (NIR) device, a mid-infrared (MIR) device, a far-infrared (FIR) device, an ultraviolet (UV) device, a light emitting diode (LED) device, a light emitting element with filament, a light emitting element with gas, a reflection element, a refraction element, and a thermal radiation device.

4. The method of claim 1, wherein operating the cryogenic pump to cause the pressure in the process chamber to satisfy the first threshold pressure further comprises activating the second capture plate module capture gas molecules within a molecular absorption region of the cryogenic pump.

5. The method of claim 4, wherein activating the second capture plate module further comprises causing movement of the second capture plate module via vibration, rotation, or tilting.

6. The method of claim 5, wherein causing movement of the second capture plate module further comprises causing movement of the second movable capture plate module at periodic time intervals.

7. The method of claim 1, wherein a molecular absorption region of the cryogenic pump is between the first end and the second end, and wherein the sides of the body slope radially outward, in relation to the longitudinal axis, from the first end and to the second end.

8. The method of claim 1, wherein the first capture plate module that is fixed is positioned between the process chamber and the second capture plate module that is moved.

9. A method for semiconductor processing, comprising:

operating a vacuum pump coupled to a process chamber to cause a pressure in the process chamber to satisfy a first threshold pressure;

operating, when the pressure satisfies the first threshold pressure, a cryogenic pump coupled to the process chamber to cause the pressure in the process chamber to satisfy a second threshold pressure that is less than the first threshold pressure, the cryogenic pump including:

a body having a flange, coupled to the process chamber, and an opening defined at a first end of the body, wherein a longitudinal axis of the body is defined from the first end of the body to a second end of the body, wherein the body has a non-cylindrical shape with a circumferential side of the body that slopes radially outward, in relation to the longitudinal axis, from the first end to the second end, and wherein one or more capture plate modules are disposed in the body, the one or more capture plate modules comprising at least one fixed capture plate module and at least one movable capture plate module;

activating the one or more capture plate modules during operation of the cryogenic pump; and processing, when the pressure is less than or equal to the second threshold pressure, a semiconductor substrate enclosed in the process chamber.

10. The method of claim 9, wherein the at least one movable capture plate module comprises at least one array of blades that is movable via vibration, rotation, or tilting.

11. The method of claim 9, further comprising:

regenerating the cryogenic pump, via a radiation device, after the processing of the semiconductor substrate.

12. The method of claim 11, wherein regenerating the cryogenic pump further comprises:

activating the radiation device, when one or more capture plate modules disposed in the body satisfy an upper threshold level of gas molecule saturation, to lower the gas molecule saturation; and operating the radiation device until the gas molecule saturation satisfies a lower threshold saturation level.

13. The method of claim 12, wherein a time frame for lowering the gas molecule saturation from the upper threshold level to the lower threshold level is 20 minutes or less.

14. A method for semiconductor processing, comprising:

operating a cryogenic pump coupled to a process chamber, the cryogenic pump including:

a body having a flange, coupled to the process chamber, and an opening defined at a first end of the body; and a fixed capture plate module and a moving capture plate module disposed in the body, wherein a longitudinal axis of the body is defined from the first end of the body to a second end of the body, wherein a molecular absorption region of the cryogenic pump is between the first end and the second end, and wherein a circumferential side of the body slopes radially outward, in relation to the longitudinal axis, from the first end and to the second end, and wherein operating the cryogenic pump comprises moving the movable capture plate module.

15. The method of claim 14, further comprising:

loading, into the process chamber, a semiconductor substrate; and processing, during operation of the cryogenic pump, the semiconductor substrate enclosed in the process chamber;

regenerating the cryogenic pump, via a radiation device, after the processing of the semiconductor substrate.

16. The method of claim 14, further comprising:

operating a vacuum pump coupled to the process chamber to lower a pressure in the process chamber to satisfy a first threshold pressure.

17. The method of claim 16, wherein lowering the pressure to satisfy the first threshold pressure further comprises lowering the pressure to be less than or equal to the first threshold pressure.

18. The method of claim 16, wherein operating the cryogenic pump further comprises operating the cryogenic pump to lower the pressure in the process chamber to satisfy a second threshold pressure that is less than the first threshold pressure.

19. The method of claim 18, wherein lowering the pressure to satisfy the second threshold pressure further comprises lowering the pressure to be less than or equal to the second threshold pressure.

20. The method of claim 14, wherein the fixed capture plate module is positioned between the process chamber and the movable capture plate module.

* * * * *